US011653743B2

(12) United States Patent
Deioma

(10) Patent No.: US 11,653,743 B2
(45) Date of Patent: May 23, 2023

(54) BACKPACK WITH STOWED RAIN COVER

(71) Applicant: Mudroom Backpacks, Inc., San Diego, CA (US)

(72) Inventor: David M. Deioma, San Diego, CA (US)

(73) Assignee: MUDROOM BACKPACKS, INC., San Diego, CA (US)

( * ) Notice: Subject to any disclaimer, the term of this patent is extended or adjusted under 35 U.S.C. 154(b) by 77 days.

(21) Appl. No.: 17/327,532

(22) Filed: May 21, 2021

(65) Prior Publication Data

US 2021/0274914 A1 Sep. 9, 2021

Related U.S. Application Data

(63) Continuation-in-part of application No. 16/640,495, filed as application No. PCT/US2018/047066 on Aug. 20, 2018, now abandoned.

(Continued)

(51) Int. Cl.

| | |
|---|---|
| ***A45F 3/04*** | (2006.01) |
| ***A42B 1/04*** | (2021.01) |
| *A45F 3/00* | (2006.01) |

(52) U.S. Cl.

CPC ..... *A45F 3/04* (2013.01); *A42B 1/04* (2013.01); *A45F 2003/001* (2013.01); *A45F 2003/003* (2013.01)

(58) Field of Classification Search

CPC .. A45F 3/04; A45F 3/042; A45F 3/047; A45F 3/06; A45F 2003/003; A45F 2003/045

See application file for complete search history.

(56) References Cited

U.S. PATENT DOCUMENTS 1,648,565 A * 11/1927 Primley ..... A63B 47/00 206/315.9
2,223,532 A * 12/1940 Sallop ..... B60N 2/58 280/727

(Continued)

FOREIGN PATENT DOCUMENTS

JP 2012105931 A 7/2012
KR 20110019621 A 2/2011

(Continued)

OTHER PUBLICATIONS

European Search Report to corresponding EP application No. 18847494.4, dated Apr. 7, 2021, 11 pages.

*Primary Examiner* — Scott T McNurlen
(74) *Attorney, Agent, or Firm* — Ronald M. Kachmarik; Cooper Legal Group LLC

(57) ABSTRACT

A backpack including a body and at least one shoulder strap. A haul handle to be grasped and including a hollow interior and a closure so as form a selectively openable rain cover storage compartment. A rain cover configured and sized to cover at least the backpack body, the rain cover having at least a deployed condition in which the rain cover extends from the top portion downwardly to cover over the entire backpack body to protect the backpack body and the articles contained within the backpack body from precipitation while the backpack is worn by the user during precipitation, and the rain cover having at least a stowed condition within the rain cover storage compartment of the haul handle to provide padding to the haul handle when the hand of the user grasps the haul handle to pick-up the backpack.

16 Claims, 16 Drawing Sheets

Related U.S. Application Data

(60) Provisional application No. 62/548,346, filed on Aug. 21, 2017.

(56) References Cited

U.S. PATENT DOCUMENTS

| | | | | |
|---|---|---|---|---|
| 5,409,153 | A * | 4/1995 | Ristich | A45C 1/04 D3/238 |
| D509,653 | S | 9/2005 | Yu | |
| 7,374,071 | B2 | 5/2008 | Lavelle | |
| 2016/0135574 | A1 | 5/2016 | Killion | |

FOREIGN PATENT DOCUMENTS

| | | | | |
|---|---|---|---|---|
| KR | 20120081720 | A * | 7/2012 | |
| WO | WO-2019040361 | A1 * | 2/2019 | A45C 13/03 |

* cited by examiner

BACKPACK WITH STOWED RAIN COVER

RELATED APPLICATIONS

Benefit of priority is claimed from U.S. patent application Ser. No. 16/640,495 filed Feb. 20, 2020, which is a National Stage Application of PCT/US2018/047066, filed Aug. 20, 2018, and U.S. Provisional Patent Application No. 62/548,346, filed Aug. 21, 2017, with all of the disclosures of these applications being incorporated herein by reference.

BACKGROUND OF THE INVENTION

Technical Field

The present invention relates generally to backpacks. More particularly, the present invention relates to backpacks having storage compartments for backpack accessories or other activity-specific accessories and gear, such as hoods, ponchos, raincoats, canopies, ground covers, blankets, and the like.

Background Art

It is known to conceal and stow various kinds of gear and accessories in various pockets and pouches of backpacks or other kinds of carry bags. Exemplary teachings include:

U.S. Pat. No. 9,125,477, to Killion, teaches a backpack having a two-panel hood stowed in, and deploying from, zippered compartments in the shoulder straps.

U.S. Pat. No. 7,374,071 to Lavelle discloses raingear housed in a pocket located on the top of the backpack so as to allow the wearer to reach over his shoulders to grab hold of a portion of the raingear.

U.S. Patent Application Ser. No. 20050050614, by Leung, shows a backpack type satchel having a hood stowed in a compartment at the upper convergence of the shoulder straps.

U.S. Pat. No. 5,743,448, to Tsai teaches a raincoat concealing backpack that provides a zippered storage compartment integrated into the pack material on the side of the pack usually borne against the back of the user.

U.S. Design Pat. D509,653 to Yu, discloses a backpack with an integrated cover that stows in a zippered compartment immediately proximate the haul strap.

U.S. Pat. No. 8,727,190 to Blair discloses a backpack hunting blind that may be used, for example, as a hunter blind and backpack frame. The camouflage cover deploys from the upper and inner portions of the frame members, not from a haul strap.

U.S. Pat. No. 7,051,908 to Mignano discloses a backpack hunting blind with rear portion and hunting blind in a deployed position.

U.S. Patent Publication No. 2010/0078457 to Pitchford et al. discloses a hooded backpack and speaker combination device having a plurality of pockets on its shoulder straps.

U.S. Patent Publication No. 2014/0216511 to Brown et al. discloses an outdoor shelter system comprising a moveable rain fly coupled based layer and support apparatus. It is representative of covers/shelters that store and deploy from packs, but does not include disclosure regarding a rain cover stowed and deployed from a haul strap.

U.S. Design Pat. No. D509,653 to Yu discloses a backpack with an integrated cover. The cover is stored within, and deployed from, a main body of a backpack. The cover is not to be stored within, nor deployed from, any part of the backpack other than the main body of the backpack. Specifically, the cover is not to be stored within, nor deployed from, a haul handle. Further, the cover is affixed (i.e., integrated) to the main body of the backpack. See that the affixing of the cover is within the main body of the backpack, with a zipper extending directly over the cover when the cover is stored within the main body. The cover is not to be separated from the main body of the backpack. Still further, as best observed in FIGS. 3, 4 and 7 of Yu, the affixed cover extends directly out from the main body portion. With the cover affixed to the main body of the backpack but with the zipper opened, there is no structure that is interposed between the storage location within the main body portion and the extension of the affixed cover out of the main body portion.

U.S. Patent Publication No. 2007/0272570 to Brooks discloses a sports bag system. The bag system has a long, sling-over-shoulder-style strap as a main portion. In use, the sling-over-shoulder-style strap is slung over a user's shoulder from fore to aft. At each of the fore and aft ends of this sling-over-shoulder-style strap, different types of accessory bags/pouches/pockets can be removably connected thereto. At the shoulder blade area of the sling-over-shoulder-style strap, and between a cushion pad and an end connection, a zippered pocket is provided. Within the zippered pocket is an integrally-attached, via an interior connection end, bag. The bag includes a zipper. An article, such as a basketball, can be held within the bag when the bag is deployed out of the zippered pocket. As is seen in FIGS. 1 and 2*a*, the article is held within the bag and rides upon the back/shoulder blade of a user during use of the sports bag system.

Indeed, while all of the foregoing patents reflect the current state of the art of which the present inventor is aware, none disclose, teach, suggest, show, or otherwise render obvious, either singly or when considered in combination, the invention described herein. There are, in fact, no known prior art products or teachings describing a backpack having a rain cover incorporated into, and concealed within, a haul strap. Accordingly, while the foregoing patents reflect the current state of the art of which the present inventor is aware, reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

DISCLOSURE OF INVENTION

The present invention is a backpack having an associated (backpack) rain cover for pack and person concealed within and deployable from a modified haul strap. The storage compartment thus does not utilize any pockets or other storage areas needed for gear. Further, the stowed rain cover adds padding to the haul handle, a feature of no small significance when consideration is given to how uncomfortable thin haul straps are when carrying loaded backpacks. Indeed, the modest but meaningful expansion in cross-sectional dimension, as well as the padding added by the stowed rain cover, makes the haul strap a comfortable carry strap even for heavy loads.

The inventive method and apparatus for stowing a rain cover may be incorporated into virtually any type of backpack of any size, whether a small 5 liter daypack, a larger 30-50 liter weekend pack, or a 70+ liter multiday backpack, though it is particularly well-suited for use with backpacks of the kind described in U.S. Pat. Appl. Publ. No. 2016/0227908, which is incorporated in its entirety by reference herein.

It is therefore an object of the present invention to provide a new and improved stow compartment for a backpack rain cover.

It is another object of the present invention to provide a new and improved haul strap adapted for use as a primary carrying haul handle that provides enhanced comfort while simultaneously providing an entirely discrete functional advantage—namely, the storage compartment for a rain cover.

A further object or feature of the present invention is a new and improved backpack that provides a discrete storage pocket for a (potentially) wet article, thereby protecting other stowed goods from getting wet.

Other novel features characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

BRIEF DESCRIPTION OF THE DRAWINGS

The invention will be better understood and objects other than those set forth above will become apparent when consideration is given to the following detailed description thereof. Such description makes reference to the annexed drawings wherein.

BEST MODE FOR CARRYING OUT THE INVENTION

Figure 1:
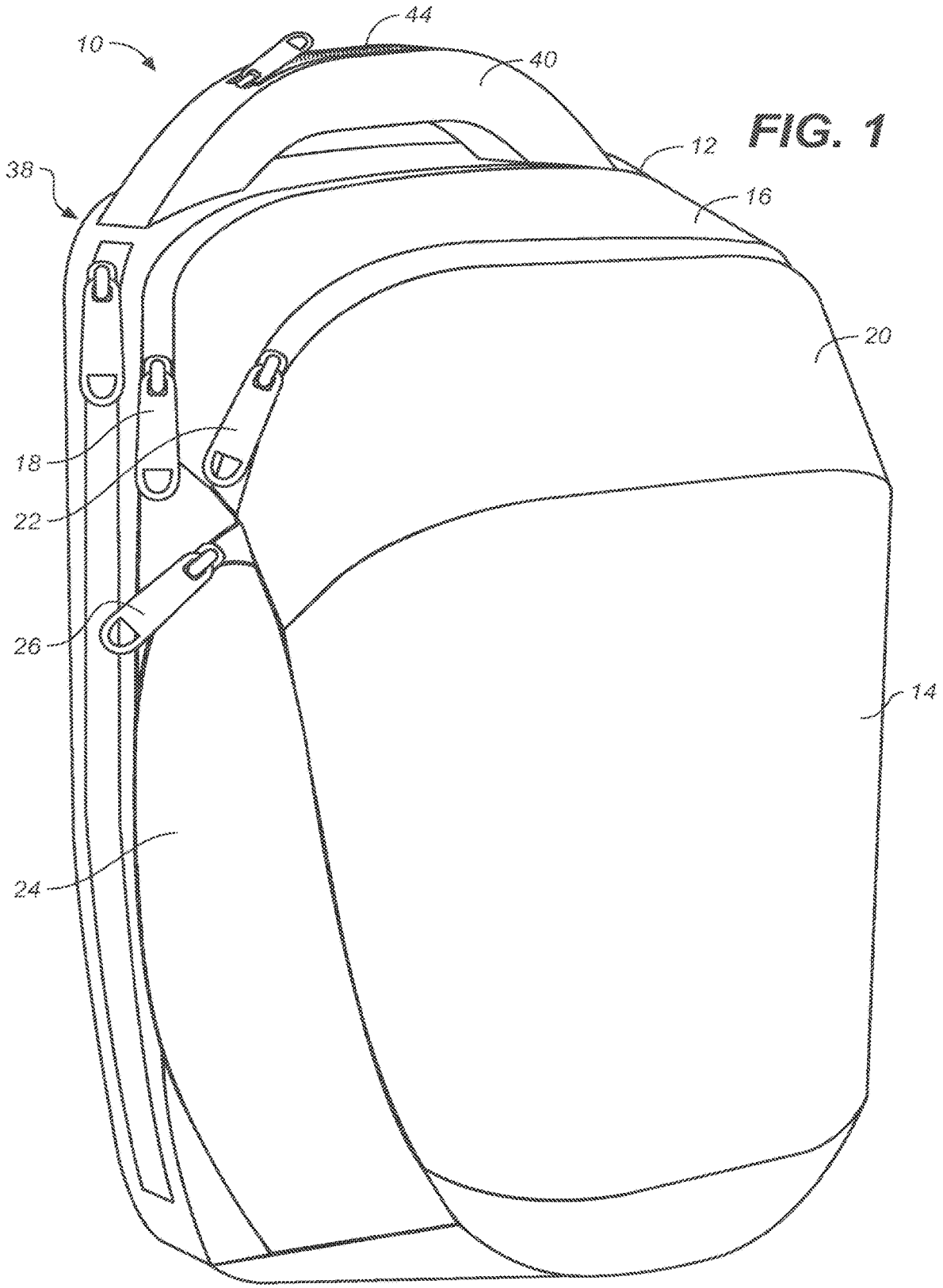
FIG. 1 is an upper front left perspective view of the inventive rain cover storage apparatus incorporated in a backpack haul strap.
Figure 2A:
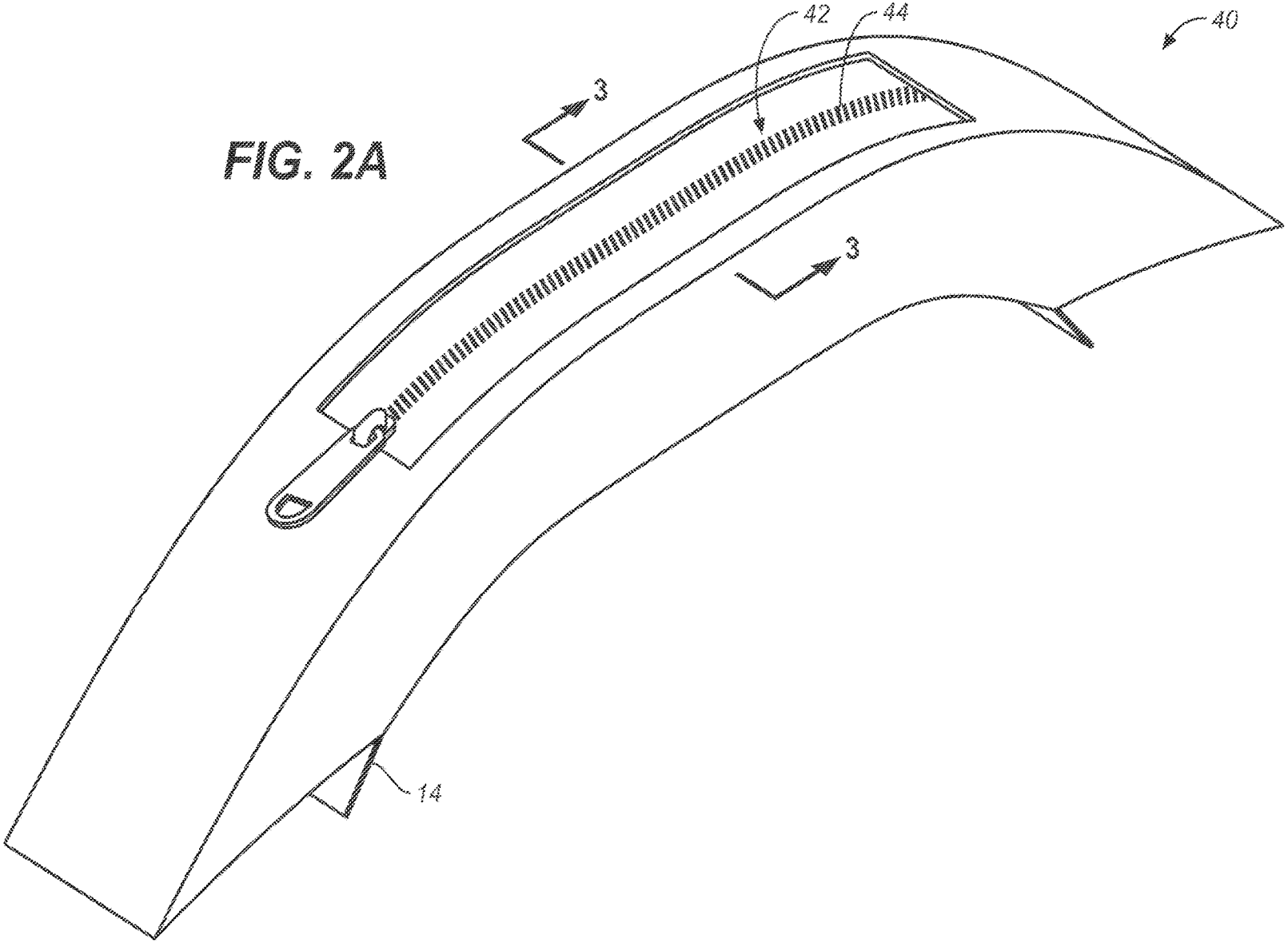
FIG. 2A is an upper perspective view showing the haul strap with a zipper as a closure device and the rain cover entirely stored and concealed within the strap storage volume.
Figure 2B:
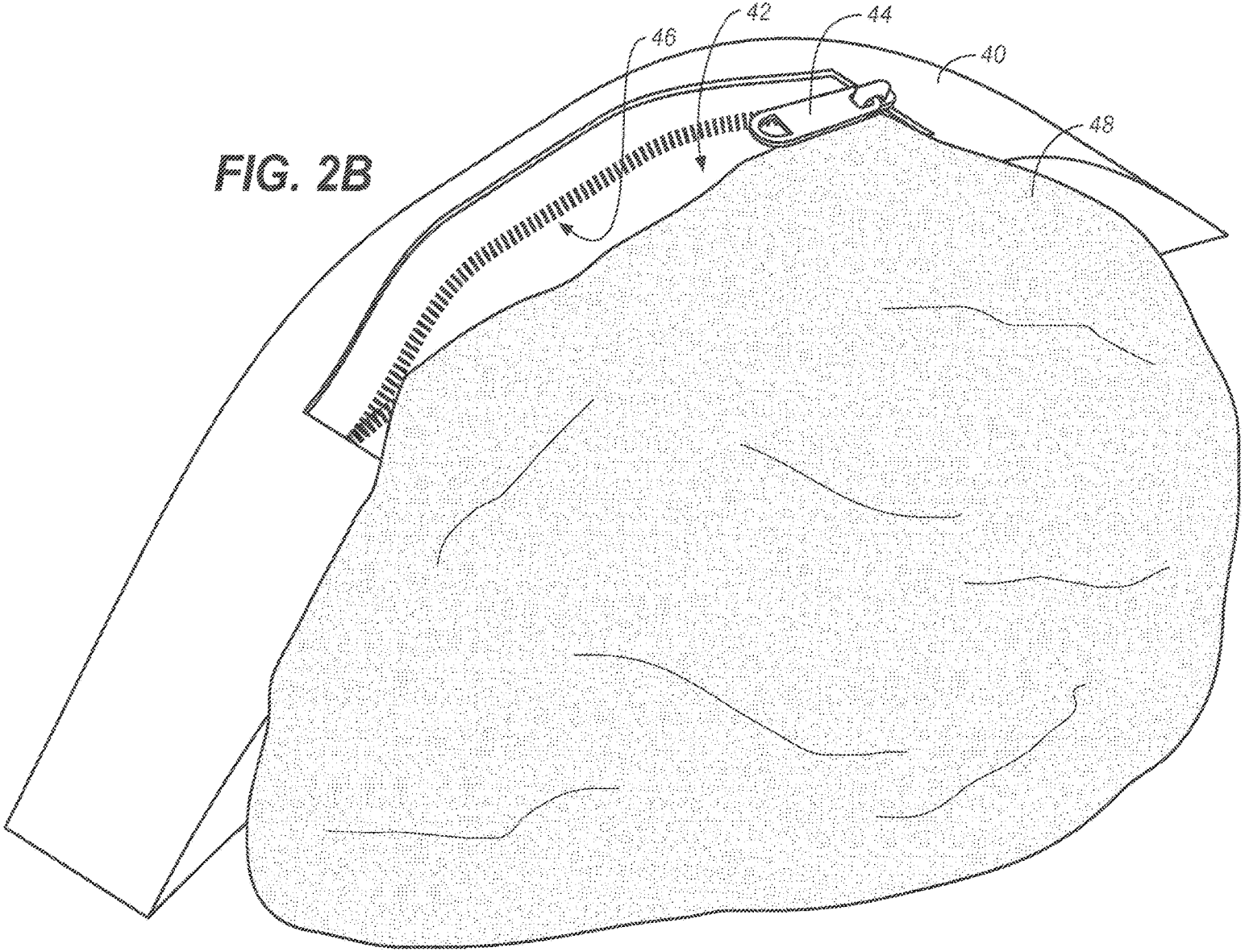
FIG. 2B is the same view showing the zipper open and the stowed rain cover partially deployed.
Figure 3:
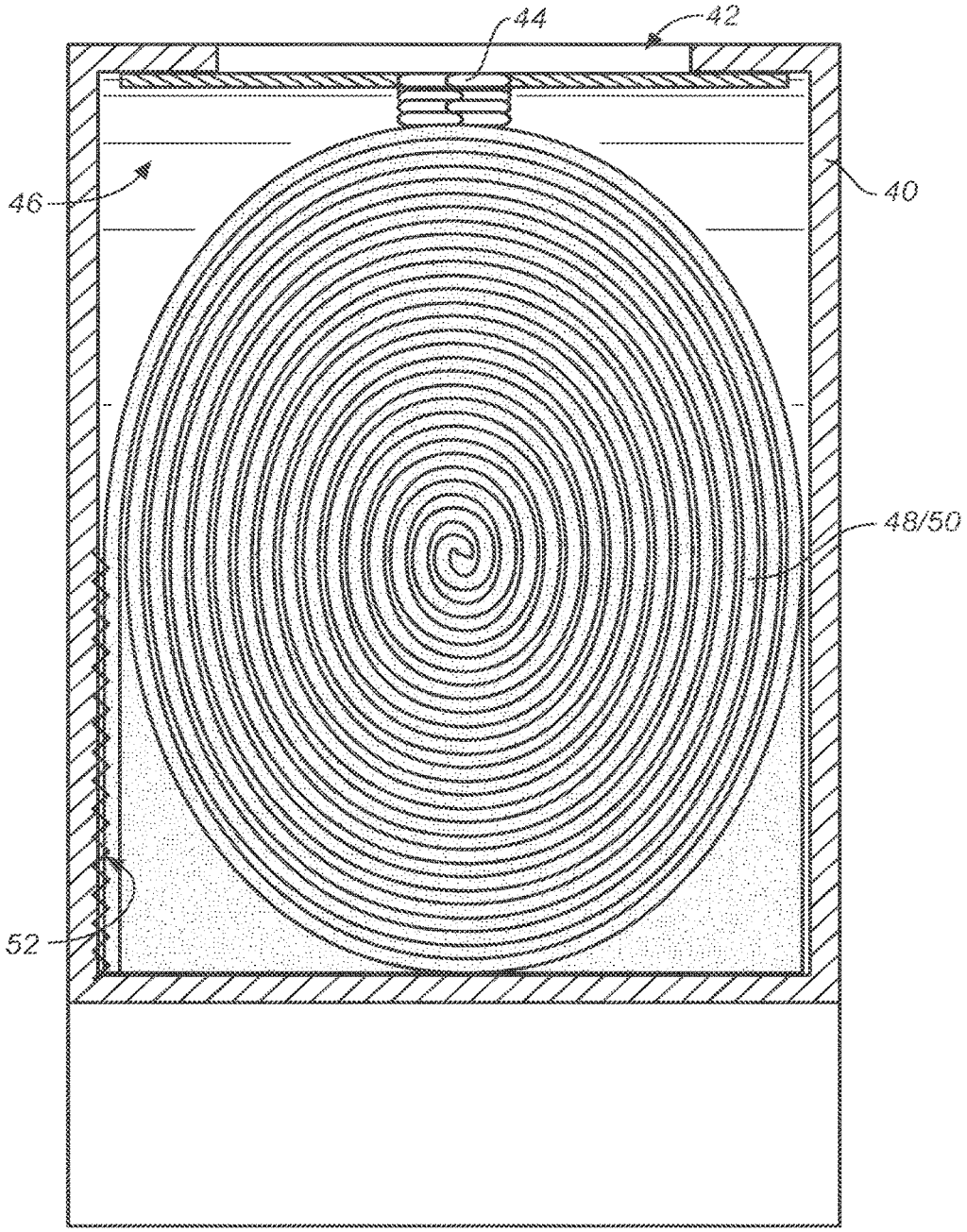
FIG. 3 is a cross-sectional side view in elevation of the haul handle taken along section line 3-3 of FIG. 2A.
Figure 4C:
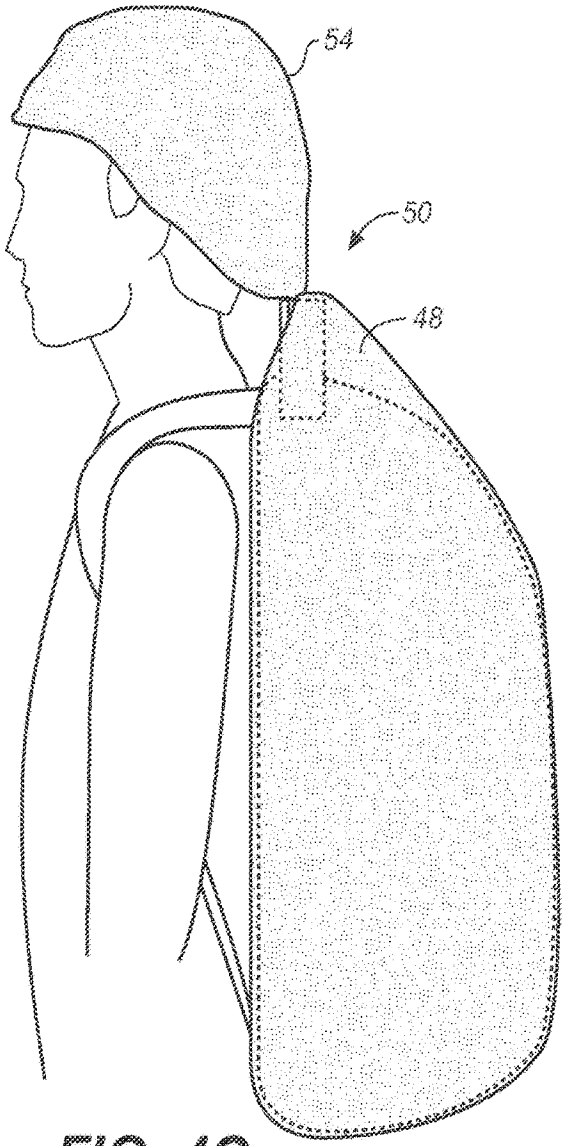
FIG. 4C is the same view showing the hood fully covering the head of the wearer.
Figure 4B:
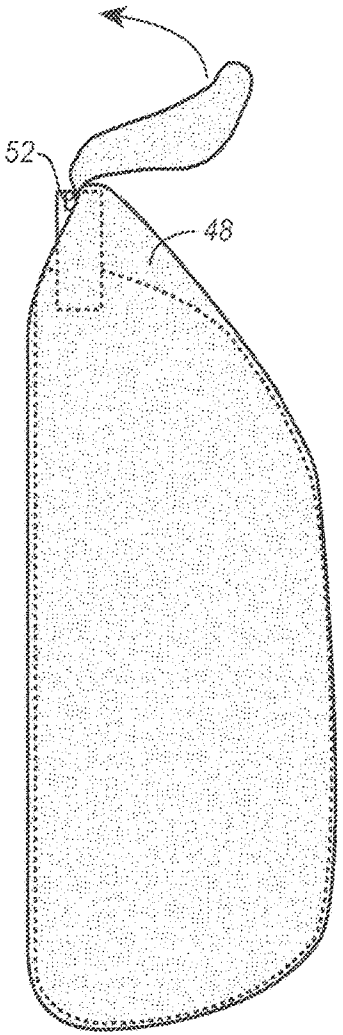
FIG. 4B is the same view showing the rain cover pulled over to fully cover the backpack with the hood partially deployed.
Figure 4A:
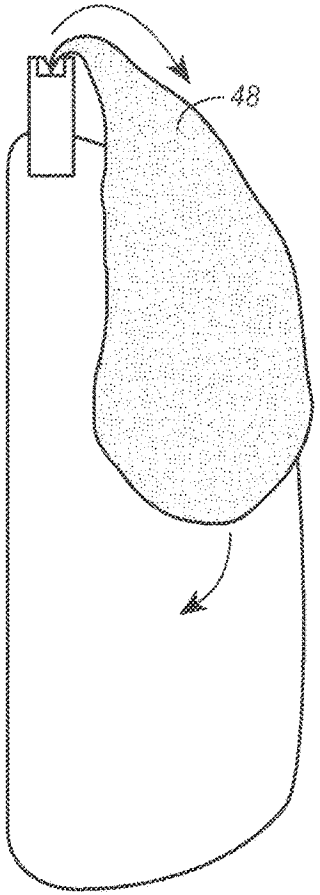
FIG. 4A is a left side view in elevation showing the rain cover and hood partially deployed from the haul strap.
Figure 5:
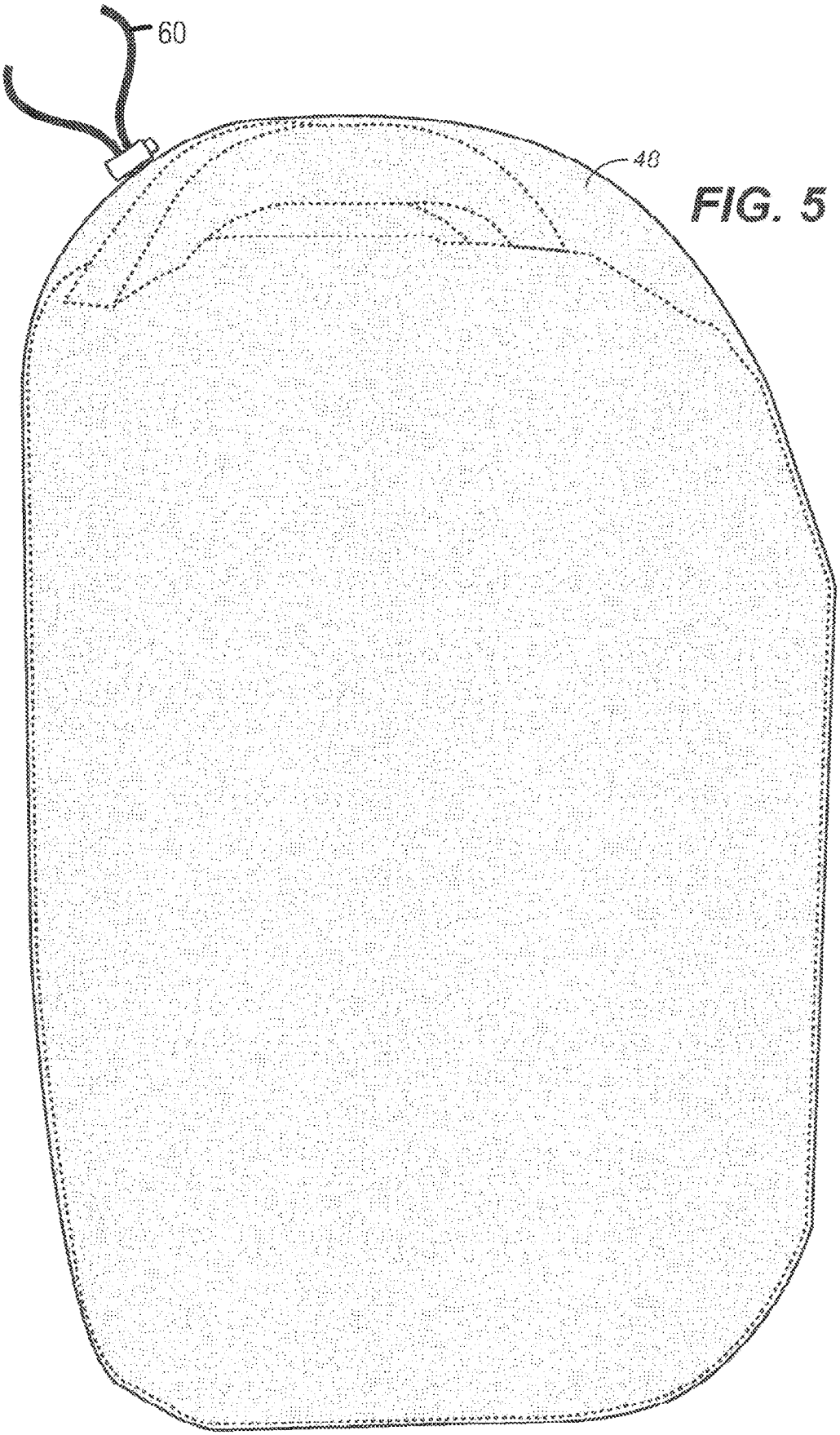
FIG. 5 is a front left perspective view showing the rain cover fully deployed and enclosing the backpack itself.
Figure 6:
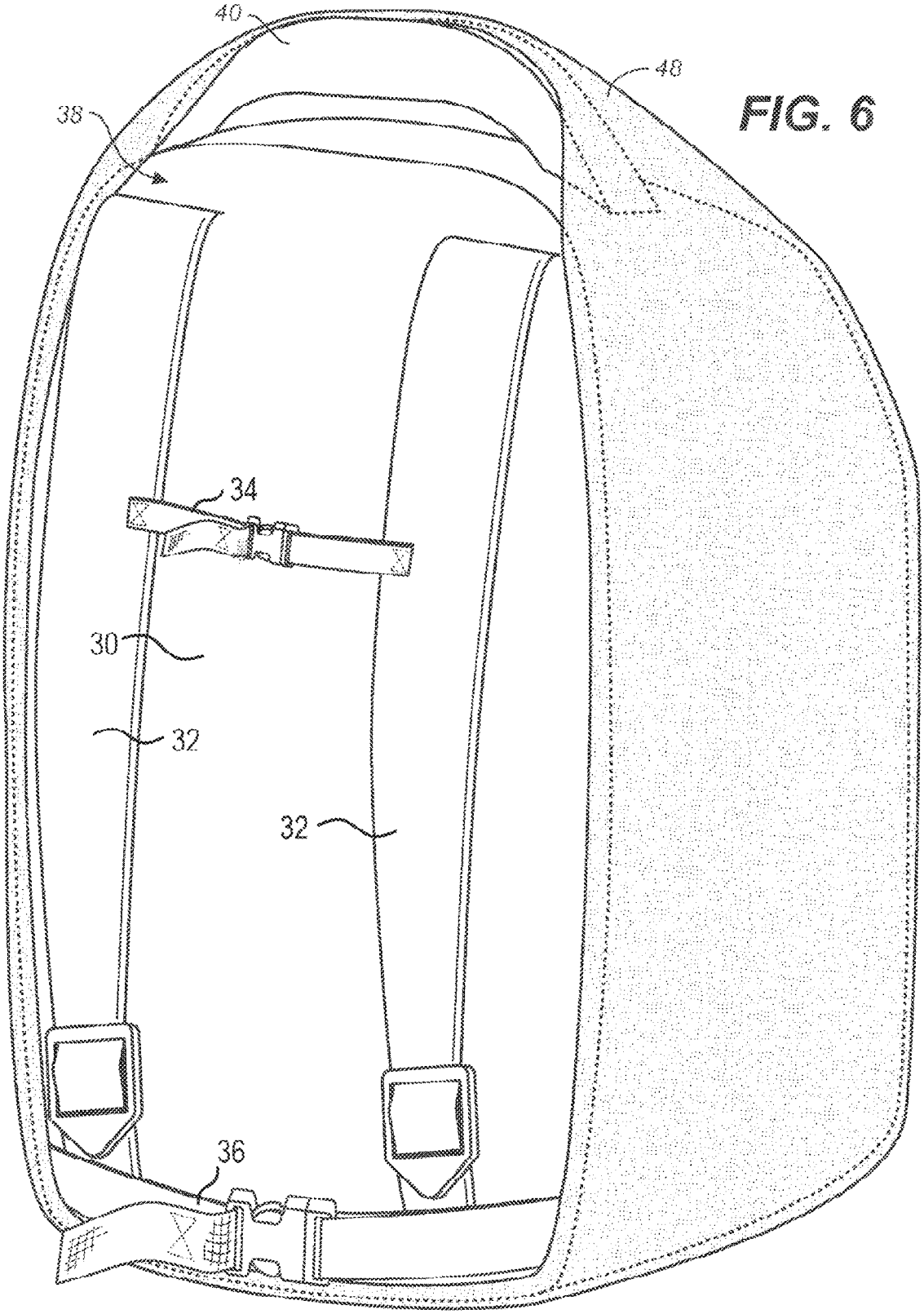
FIG. 6 is an upper rear left perspective view (side facing the wearer) showing the rain cover enclosing the backpack with the shoulder straps, waist belt, and chest straps exposed.
Figure 7:
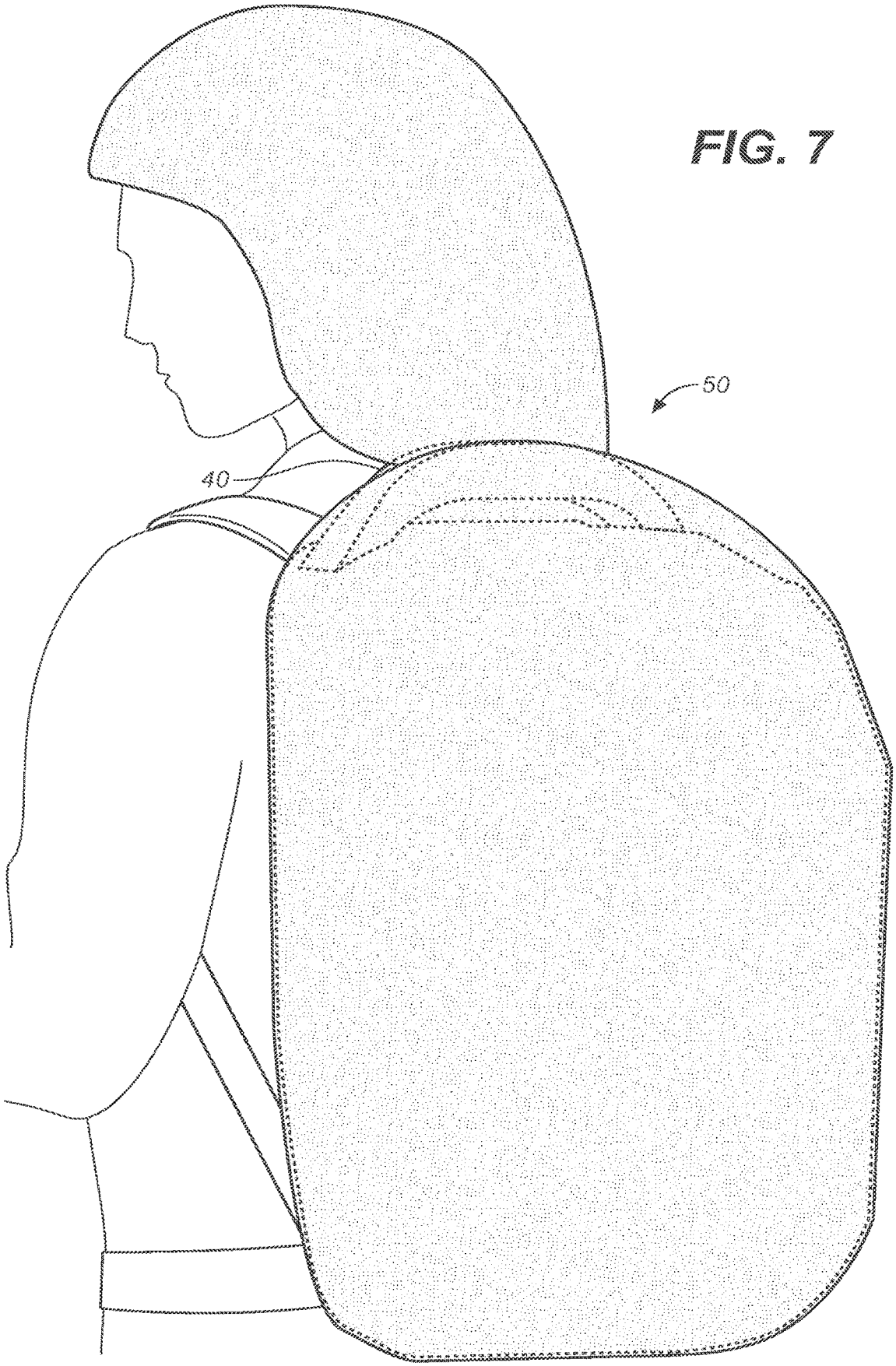
FIG. 7 is a front perspective view showing the rain cover fully deployed, covering the backpack, with the integral hood covering the head of the user.

Referring to FIGS. 1 through 7, wherein like reference numerals refer to like components in the various views, there is illustrated therein a new and improved method and apparatus for storing a backpack rain cover in a haul strap, the invention generally denominated 10 herein.

In an embodiment, and in its most essential aspect, the backpack 10 incorporating the inventive rain cover storage and deployment apparatus may be embodied as a daypack, travel pack, rucksack, or multi-day excursion pack. In the views, the system is shown incorporated in a daypack style backpack 12. The overall backpack includes a backpack body 14 constructed of a flexible fabric, either synthetic or natural, and most typically a woven polymeric or nylon fabric.

The backpack body 14 is typically laterally symmetrical (from right to left) about a vertical axis (in the transverse plane), and asymmetrical anteriorly and posteriorly about a vertical axis in the coronal plane, though small variations in componentry may be included on either side of the backpack body. In a daypack-style backpack, such as that shown in the views, there will be included a primary front compartment 16 accessible by an opening selectively closed by a zipper or other closure device 18 (hook-and-loop, snaps, buttons, etc.), a secondary (or front) compartment or pocket 20, also accessible through an opening selectively closed by a zipper or other closure device 22, and one or more side pockets 24, again having selectively closeable zippered openings 26. The back side 28 of the pack includes a back panel 30 and various carry straps, including padded shoulder straps 32, a sternum strap 34, a padded hip belt 36, possibly including an integral lumbar pad.

The upper portion 38 of the pack includes a pack handle or haul strap handle (or simply haul handle) 40, generally disposed either between the shoulder straps or at the top of the pack. The haul handle is interiorly hollow and opens through a zippered or other closure opening 42 having a zipper or other closure feature 44 and provides a stowage compartment 46 into which a rain/pack cover 48 may be stowed. The rain cover may be a pack cover only, a combined pack cover and hood 50, a poncho and integral hood, and the like. Further, the rain cover may be connected to the interior of the storage compartment, for instance by stitching 52, such that the rain/pack cover 48 portion tends to deploy downwardly while the hood 54 portion for the user tends to deploy upwardly, or above the pack cover. Alternatively, the rain cover may be kept entirely loose or free from any physical connection to the storage compartment interior such that it may be used independently of the backpack. The rain cover may also be provided with means for securing the cover tightly around the backpack, such as by an elastic drawstring closure or cinch closure with a cord lock or cord stopper 60.

It is to be noted that the shown example presents the haul handle 40, and thus the contained rain cover 48 therein, away from the portions (e.g., the shoulder straps 32) of the backpack 10 that directly engage the body of the use and/or the backpack body 14 itself, which, of course, is for contents that are to be protected from water, etc. To be clear, the haul handle 40, and thus the contained rain cover 48 therein, is not integrated into the shoulder straps 32 and/or the backpack body 14. Such construction is such that even if the rain cover 48 might be re-stowed after use (i.e., possibly wet), there is no transfer of water, etc.

Figure 8:
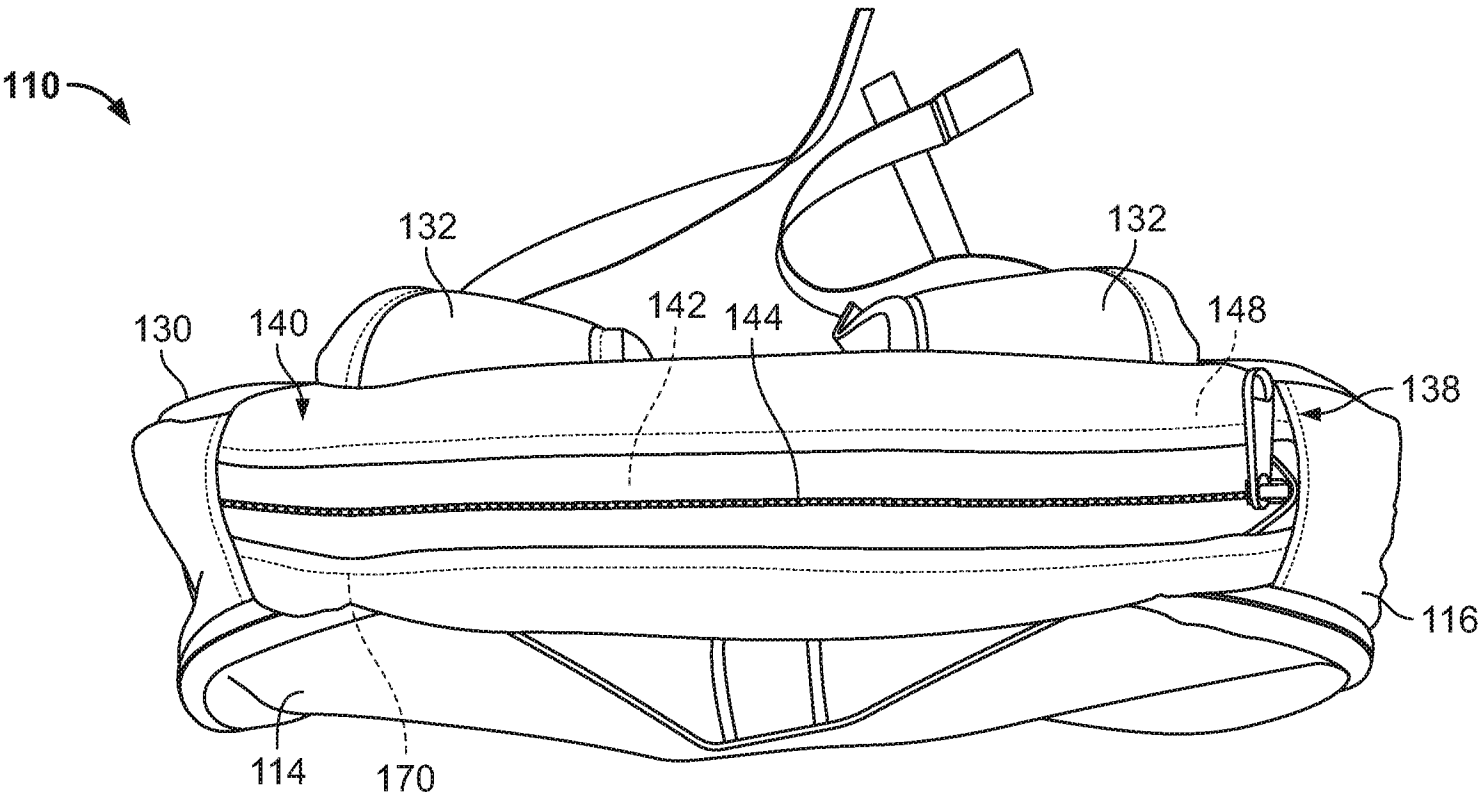
FIG. 8 is a top view of an example of the inventive rain cover storage apparatus incorporated in a backpack haul strap of a backpack, with a closure zipper closed and a stowed rain cover hidden inside of the backpack haul strap.

FIG. 8 is a top view of an example of the inventive rain cover storage apparatus incorporated in a backpack haul strap handle (or simply haul handle) 140 of a backpack 110, with a closure device/feature (e.g., a zipper) 144 to close a closure opening 142 (not yet open in FIG. 8) and a stowed rain cover 148 (hidden/not visible in FIG. 8) hidden inside of the closed haul handle 140.

It is to be noted that the backpack 110 may include all or some of the structures/features presented for the above-discussed examples. For example, the rain cover 148 may have all or some of the same structures/features (e.g., closure means such as a draw string/closure stopper, sized to be a combined pack cover and hood) as presented for the other examples. Also, it is to be noted that the backpack 110 may include additional and/or different structures/features as compared to the above-discussed examples. Within an example, the backpack 110 may include, at least, a backpack body 114, a primary front compartment 116, a back side 130, one or more (e.g., two) padded shoulder straps 132.

The haul handle 140 is to be grasped by a hand of the user to pick-up the backpack 110. The haul handle 140 is a separate item from the backpack body 114 and is a separate item from the shoulder straps 132. The haul handle 140 is located at an upper portion 138 of the backpack 110 and attached to at least one of the backpack body 114 and the at least one shoulder strap 132. Within the shown example of FIG. 8, the haul handle 140 is attached to the backpack body 114. The haul handle 140 and the least one of the backpack body 114 and the at least one shoulder strap 132 to which the haul handle is attached together encircle a grasp area for receiving a hand grasping the haul handle. The haul handle 140 includes a hollow interior 170 (hidden/not visible in FIG. 8).

The hollow interior 170 and the closure device/feature (e.g., zipper) 144 provide a selectively openable rain cover storage compartment. In other words, the hollow interior 170 is a rain cover storage compartment 170 that is selectable openable/closable, at the closure opening 142, via operation of the closure device/feature (e.g., zipper) 144. It is to be noted that the rain cover storage compartment 170 is separate from and outside of the backpack body 114, and thus separate from the compartment of the backpack body 114. Such separation of the haul handle 140 and the rain cover storage compartment 170 therein from the backpack body 114 is to avoid possible contamination (e.g., water, dirt, etc.) into the body compartment of the backpack body 114 from the rain cover storage compartment 170.

Figure 9:
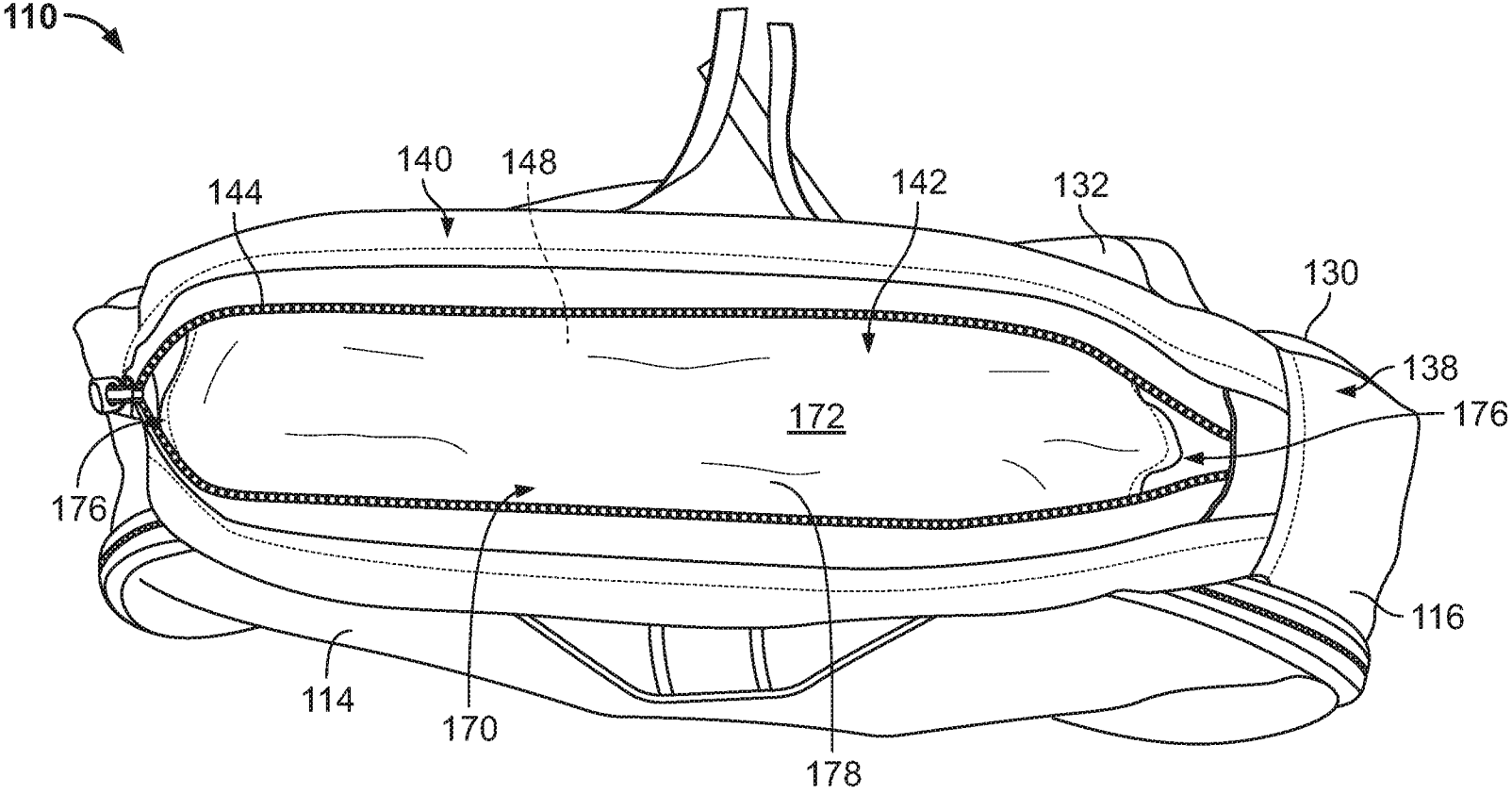
FIG. 9 is a view similar to FIG. 8, but with the closure zipper opened to reveal a segment of material located within a hollow interior of the backpack haul strap, with the segment of material having a side extending to face the closure zipper, especially we the closure zipper is closed, and with the stowed rain cover hidden behind/beneath the segment of material.

Turning to FIG. 9, note that FIG. 9 is a view similar to FIG. 8, but with the closure device/feature (e.g., zipper) 144 actuated/opened such that the closure opening 142 is open in FIG. 9. With the closure opening 142 is open, such reveals a segment of material 172 located within the hollow interior (i.e., rain cover storage compartment) 170 of the haul handle 140.

Figure 10:
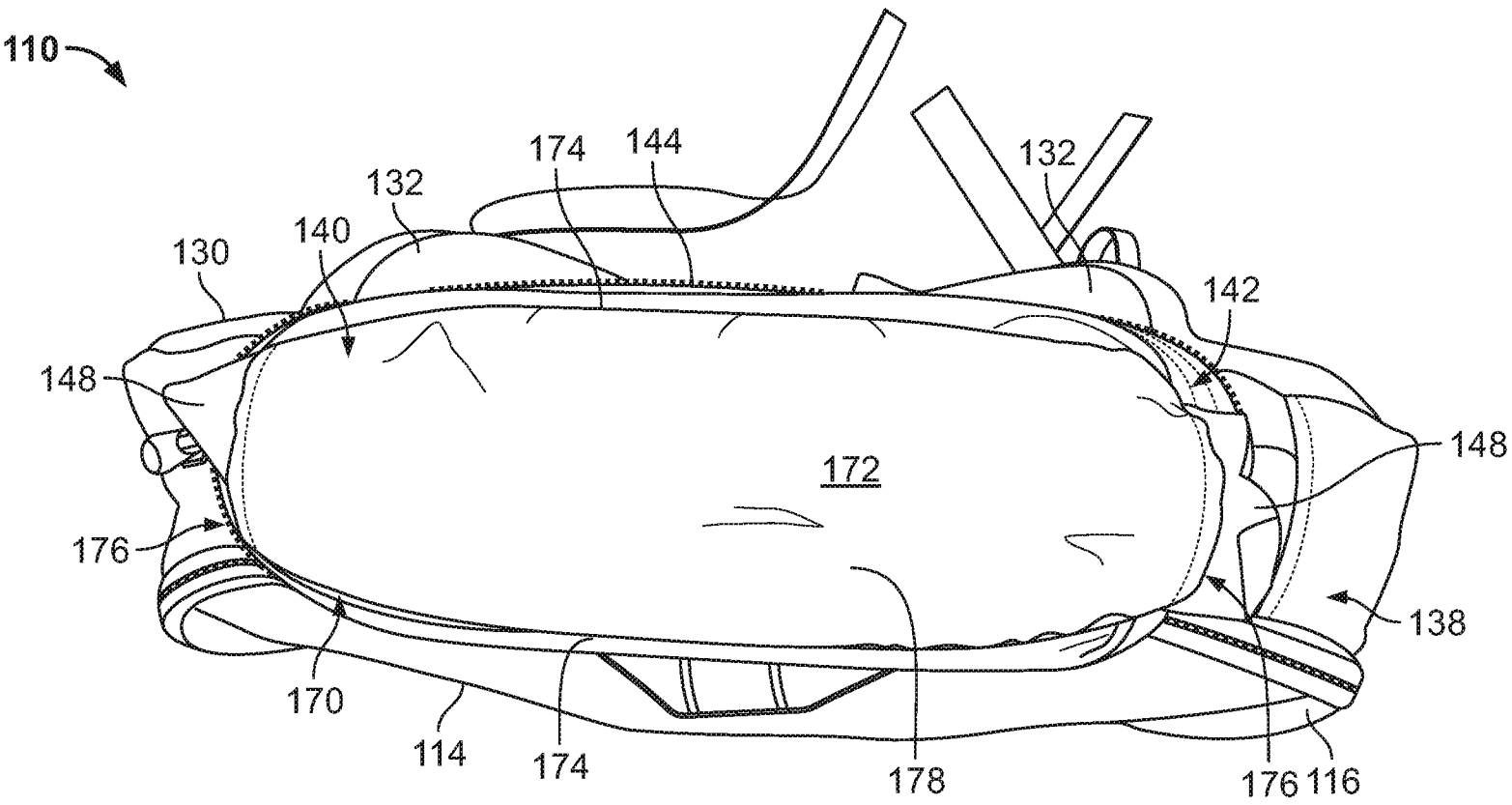
FIG. 10 is a view similar to FIG. 9, but with the backpack haul strap being opened in an accentuated manner to show a majority of a periphery of the segment of material being affixed within the haul handle and at least one portion of the periphery of the segment of material that is not affixed within the haul strap providing an access pathway, to a portion of the hollow interior on a side of the segment of material away from the closure, though which the rain cover may be stowed and retrieved, and with a portion of the rain cover visible.
Figure 11:
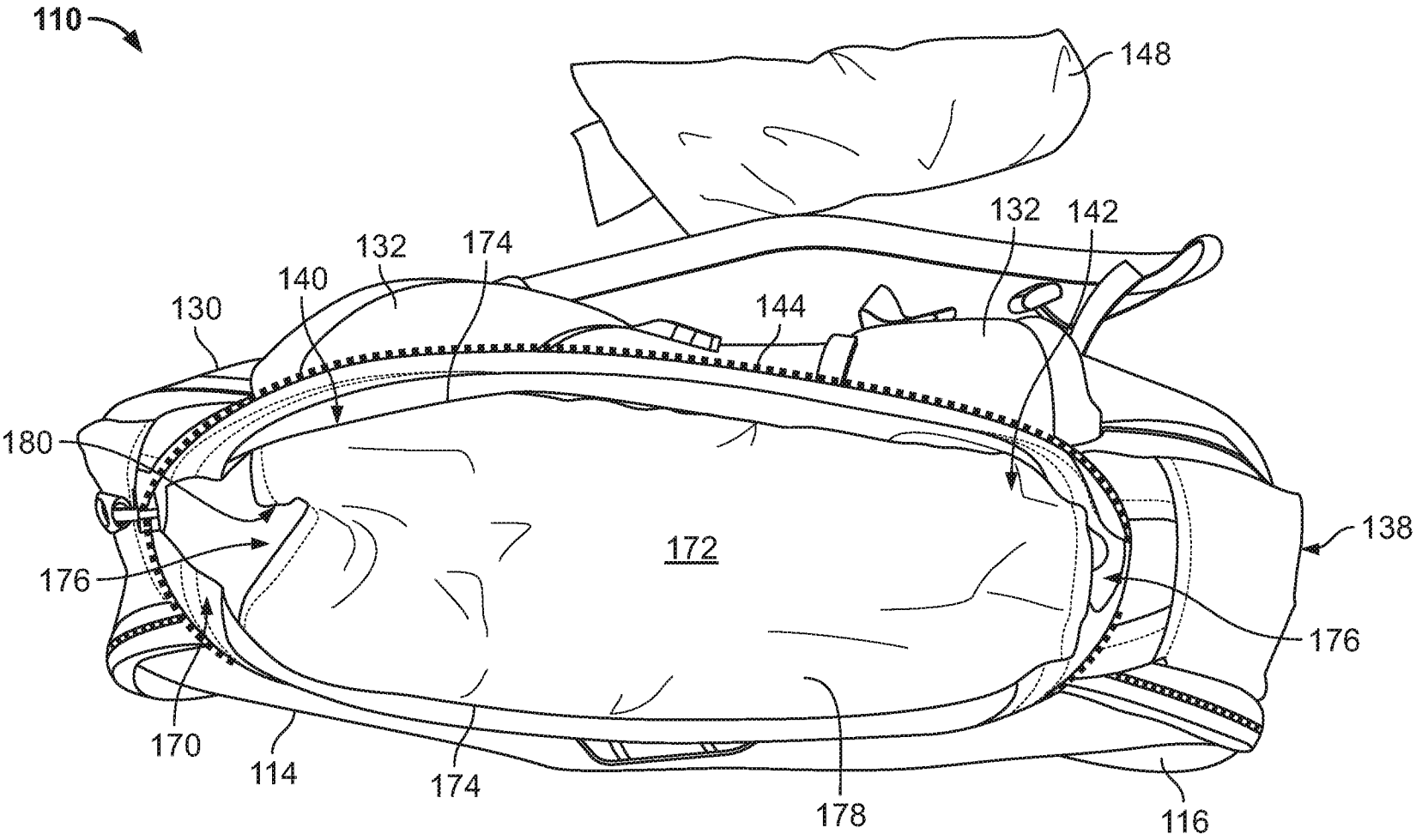
FIG. 11 is a view similar to FIG. 10, but with the rain cover retrieved from the interior of backpack haul strap and placed next to the backpack, and showing the access pathway at the segment of material that is not affixed though which the rain cover was retrieved from behind/beneath the segment of material.

FIG. 10 is a view similar to FIG. 9, but with the haul handle 140 being opened in an accentuated manner to show a majority of a periphery of the segment of material 172. As will be described further following, the segment of material 172 is affixed within the haul handle 140 and at least one portion of the periphery of the segment of material that is not affixed within the haul strap providing an access pathway, to a portion of the hollow interior on a side of the segment of material away from the closure, though which the rain cover 148 may be stowed and retrieved. FIG. 11 is a view similar to FIG. 10, but with the rain cover 148 retrieved from the interior of the haul handle 140 and placed next to the backpack 110. As will be described further following, the access pathway at the segment of material 172 that is not affixed was the pathway through which the rain cover was retrieved from behind/beneath the segment of material 172.

The haul handle 140 includes the segment of material 172 (see FIGS. 9-11) located within the hollow interior 170 of the haul handle 140. The segment of material 172 is affixed (e.g., via stitching or similar) along a majority of a periphery 174 (FIG. 10) of the segment of material within the haul handle 140. At least one portion of the periphery 174 of the segment of material is not affixed within the haul handle 140. Within the shown example, see that the open ends 176 (left and right ends as viewed within FIGS. 9-11) are not affixed.

Such provides openings at each of the two open ends 176. The two open ends 176 are at opposed ends of the segment of material 172.

The segment of material 172 has a side (e.g., a face) 178 extending to face the closure device/feature (e.g., zipper) 144, particularly when the closure device/feature (e.g., zipper) is closed. Of course, there is an opposite side (e.g., a face) extending to face away from the closure device/feature (e.g., zipper) 144. Such opposite/facing-away side is hidden and not visible in FIGS. 9 and 10. However, a small portion 180 of the opposite/facing-away side is visible in FIG. 11. Each of the open ends 176 provides the access pathway to a portion of the hollow interior 170 on a side of the segment of material 172 away from the closure device/feature (e.g., zipper). It is to be noted that the access pathway either of the open ends 176 can be used to for ingress/egress of the rain cover 148 into/from behind/beneath the segment of material 172 and thus the hollow interior (rain cover storage compartment) 170.

As can be appreciated the rain cover 148 is configured and sized to cover at least the backpack body 114. It is to be noted that the rain cover 148 is shown in FIGS. 10 and 11 in a rolled/folded condition. It is when the rain cover 148 is unrolled/unfolded to a deployed extent does the rain cover 148 provide such covering of at least the backpack body 114. Once deployed, the rain cover 148 extends, e.g., from the top/upper portion 138 downwardly, to cover over the entire backpack body 114 to protect the backpack body and the articles contained within the backpack body from precipitation, or other elements or items, while the backpack is worn by the user. So, to be clear, the rain cover 148 has at least a stowed condition within the rain cover storage compartment 170 of the haul handle 140. The rain cover 148 is completely and exclusively within the haul handle 140 and located at the side (e.g., see portion 180 within FIG. 11) of the segment of material 172 away from the closure device/feature (e.g., zipper) 144. When stowed, the rain cover 148 provides padding to the haul handle 140 when the hand of the user grasps the haul handle to pick-up the backpack 110.

It is to be appreciated that the novel use of the segment of material 172 within the haul handle 140 provides protection to the rain cover 148 so that the rain cover 148 is not damaged (e.g., torn or snagged) during operation of the closure device/feature (e.g., zipper) 144. The novel use of the segment of material 172 within the haul handle 140 provides protection to the closure device/feature (e.g., zipper) 144 such that the rain cover 148 does not become bound or lodged into the closure device/feature (e.g., zipper) during operation of the closure device/feature (e.g., zipper).

It is to be understood that the rain cover 148 is placed beneath (as viewed within the figures) the segment of material 172. Such placement of the rain cover 148 is via insertion at one of the open ends 176. In some respects, the novel use of the segment of material 172 allows the rain cover 148 to be neatly and compactly stored within the haul handle 140 via an initial holding of the rain cover 148 while the closure device/feature (e.g., zipper) 144 is operated to provide some further compacting/compression.

It is to be noted that the shown example presents the haul handle 140, and thus the contained rain cover 148 therein, away from the portions (e.g., the shoulder straps 132) of the backpack 110 that directly engage the body of the use and/or the backpack body 114 itself, which, of course, is for contents that are to be protected from water, etc. To be clear, the haul handle 140, and thus the contained rain cover 148 therein, is not integrated into the shoulder straps 132 and/or the backpack body 114. Such construction is such that even if the rain cover 148 might be re-stowed after use (i.e., possibly wet), there is no transfer of water, etc.

Figure 12:
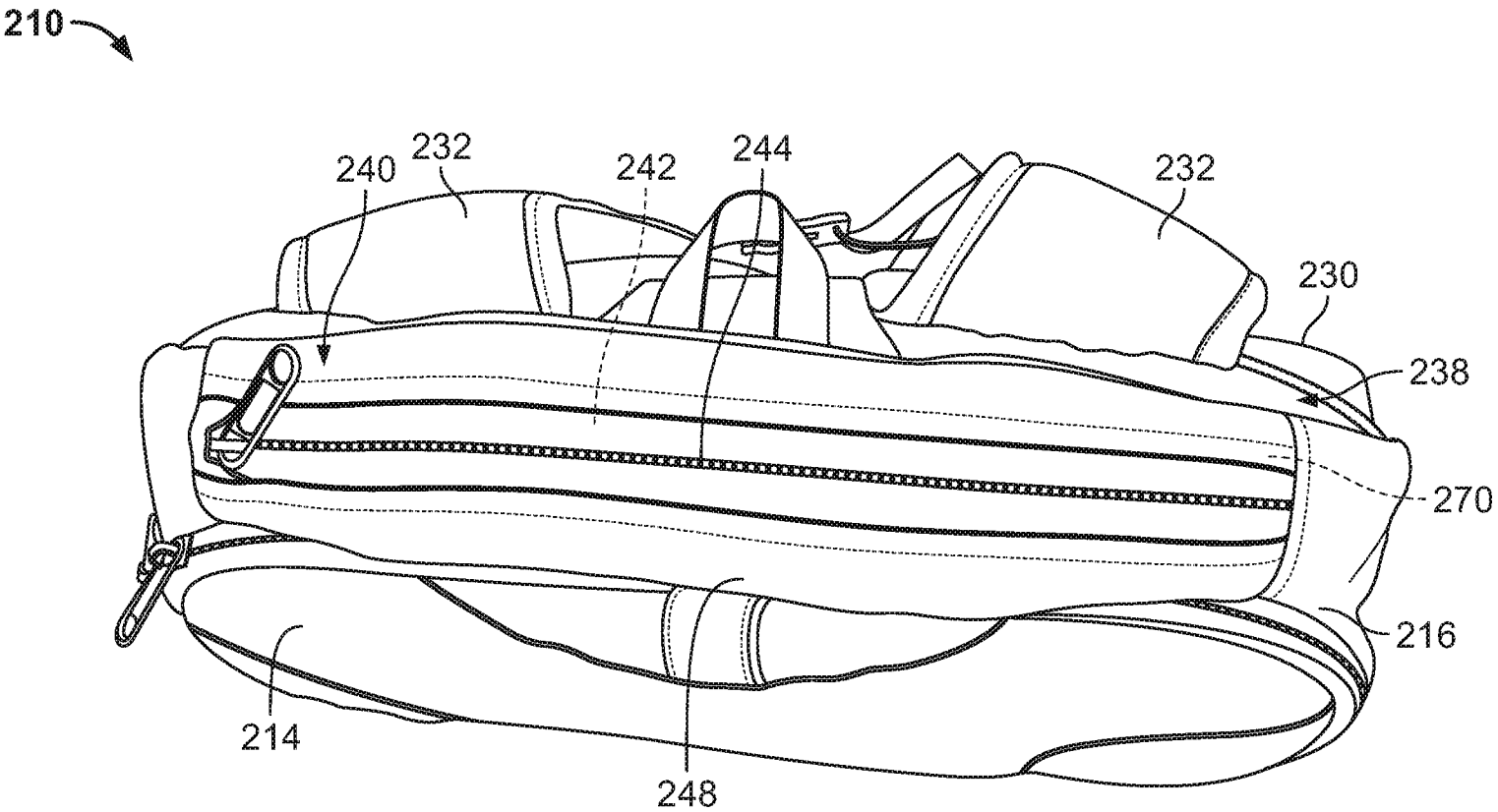
FIG. 12 is a top view of an example of the inventive rain cover storage apparatus incorporated in a backpack haul strap of a backpack, with a closure zipper closed and a stowed rain cover hidden inside of the backpack haul strap.

FIG. 12 is a top view of an example of the inventive rain cover storage apparatus incorporated in a backpack haul strap handle (or simply haul handle) 240 of a backpack 210, with a closure device/feature (e.g., a zipper) 244 to close a closure opening 242 (not yet open in FIG. 12) and a stowed rain cover 248 (hidden/not visible in FIG. 8) hidden inside of the closed haul handle 240.

It is to be noted that the backpack 110 may include all or some of the structures/features presented for the above-discussed examples. For example; the rain cover 248 may have all or some of the same structures/features (e.g., closure means such as a draw string/closure stopper, sized to be a combined pack cover and hood) as presented for the other examples. Also, it is to be noted that the backpack 210 may include additional and/or different structures/features as compared to the above-discussed examples. Within an example, the backpack 210 may include, at least, a backpack body 214, a primary front compartment 216, a back side 230, one or more (e.g., two) padded shoulder straps 232.

The haul handle 240 is to be grasped by a hand of the user to pick-up the backpack 210. The haul handle 240 is a separate item from the backpack body 214 and is a separate item from the shoulder straps 232. The haul handle 240 is located at an upper portion 238 of the backpack 210 and attached to at least one of the backpack body 214 and the at least one shoulder strap 232. Within the shown example of FIG. 12, the haul handle 240 is attached to the backpack body 214. The haul handle 240 and the least one of the backpack body 214 and the at least one shoulder strap 232 to which the haul handle is attached together encircle a grasp area for receiving a hand grasping the haul handle. The haul handle 240 includes a hollow interior 270 (hidden/not visible in FIG. 12).

The hollow interior 270 and the closure device/feature (e.g., zipper) 244 provide a selectively openable rain cover storage compartment. In other words, the hollow interior 270 is a rain cover storage compartment 270 that is selectable openable/closable, at the closure opening 242, via operation of the closure device/feature (e.g., zipper) 244. It is to be noted that the rain cover storage compartment 270 is separate from and outside of the backpack body 214, and thus separate from the compartment of the backpack body 214. Such separation of the haul handle 240 and the rain cover storage compartment 270 therein from the backpack body 214 is to avoid possible contamination (e.g., water, dirt, etc.) into the body compartment of the backpack body 214 from the rain cover storage compartment 270.

Figure 13:
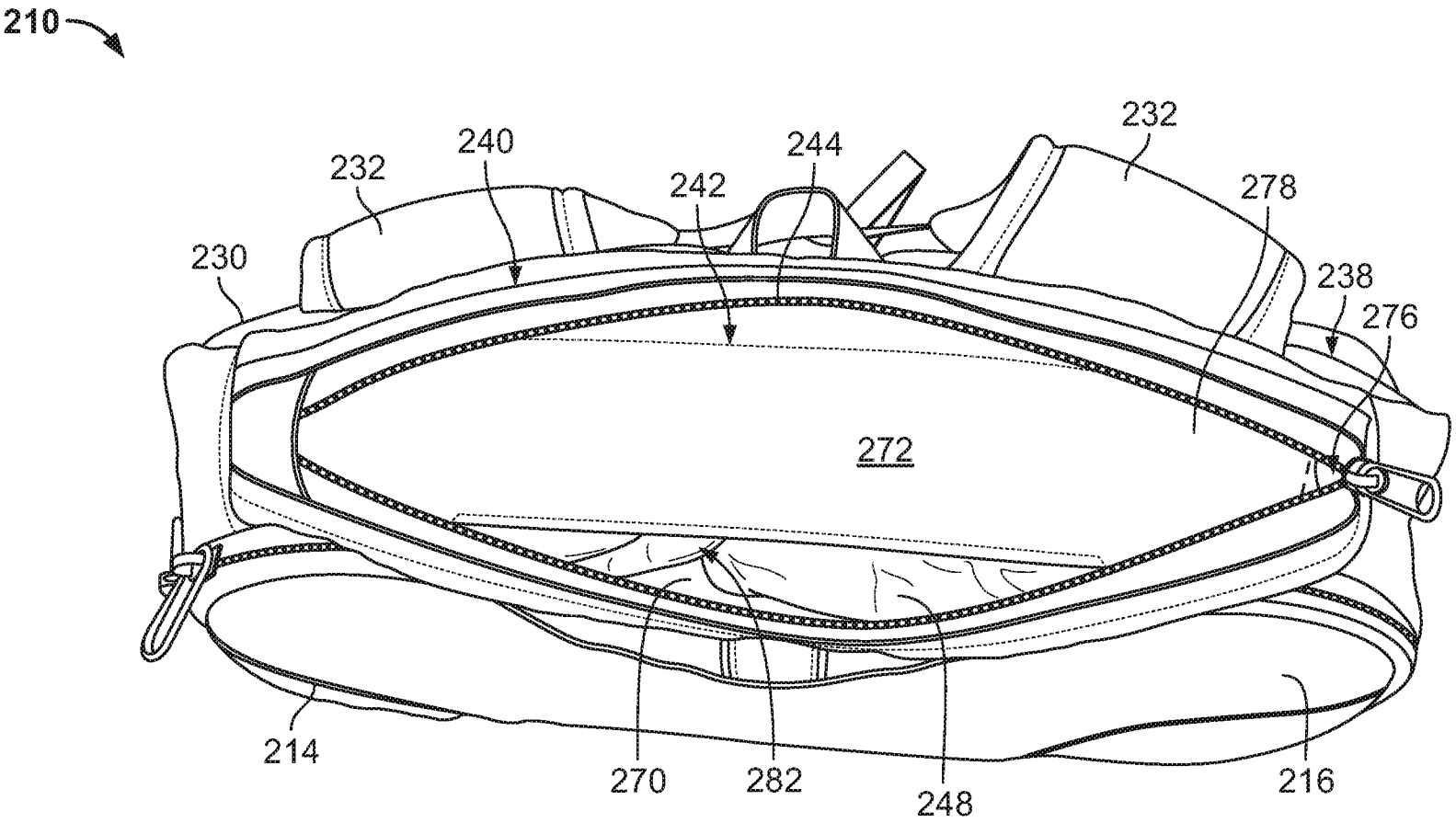
FIG. 13 is a view similar to FIG. 12, but with the closure zipper opened to reveal a segment of material located within a hollow interior of the backpack haul strap, with the segment of material having a side extending to face the closure zipper, especially we the closure zipper is closed, and with the stowed rain cover hidden behind/beneath the segment of material.

Turning to FIG. 13, note that FIG. 13 is a view similar to FIG. 12, but with the closure device/feature (e.g., zipper) 244 actuated/opened such that the closure opening 242 is open in FIG. 13. With the closure opening 242 is open, such reveals a segment of material 272 located within the hollow interior (i.e., rain cover storage compartment) 270 of the haul handle 240.

Figure 14:
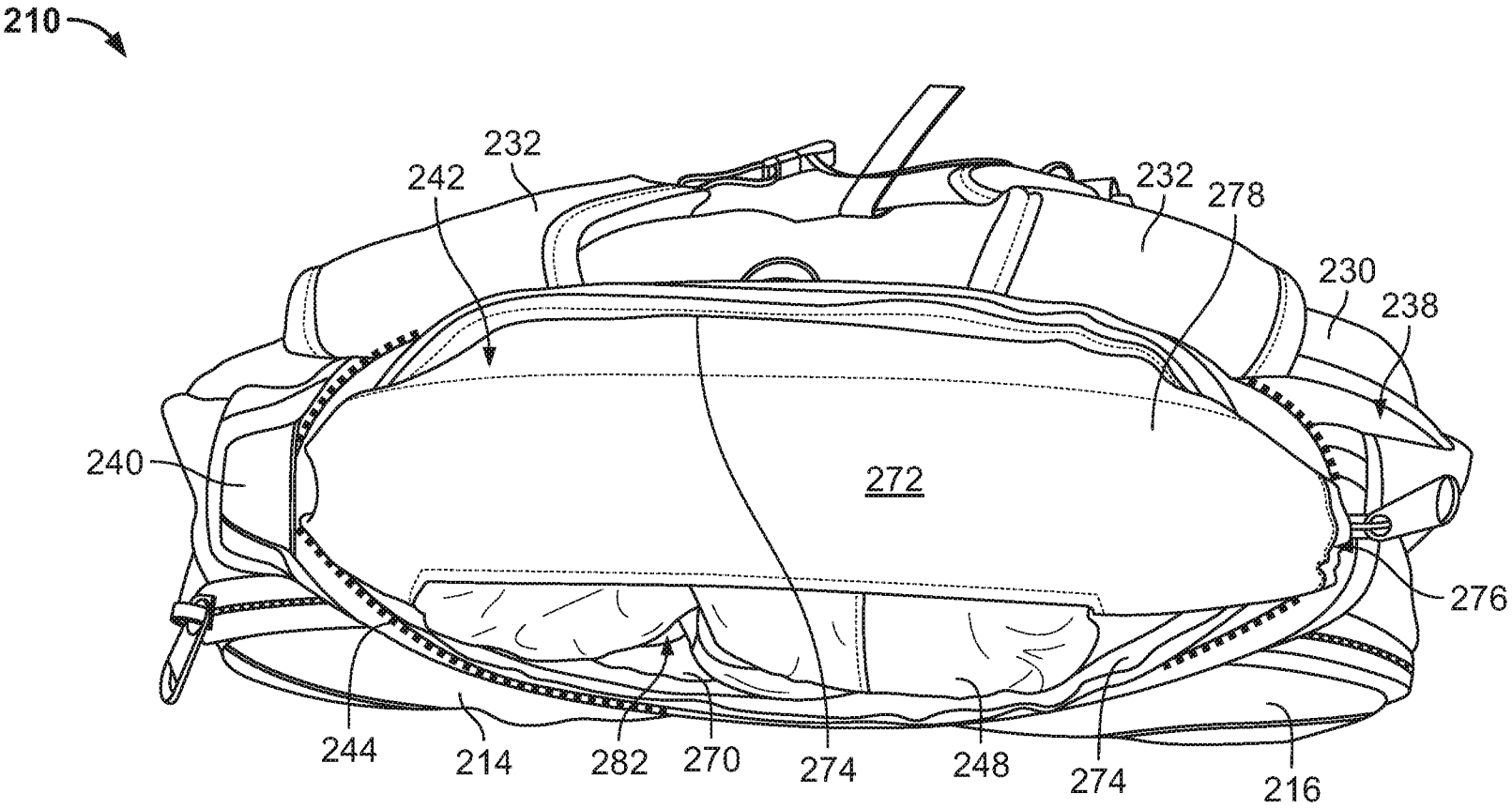
FIG. 14 is a view similar to FIG. 13, but with the backpack haul strap being opened in an accentuated manner to show a majority of a periphery of the segment of material being affixed within the haul handle and at least one portion of the periphery of the segment of material that is not affixed within the haul strap providing an access pathway, to a portion of the hollow interior on a side of the segment of material away from the closure, though which the rain cover may be stowed and retrieved, and with a portion of the rain cover visible.
Figure 15:
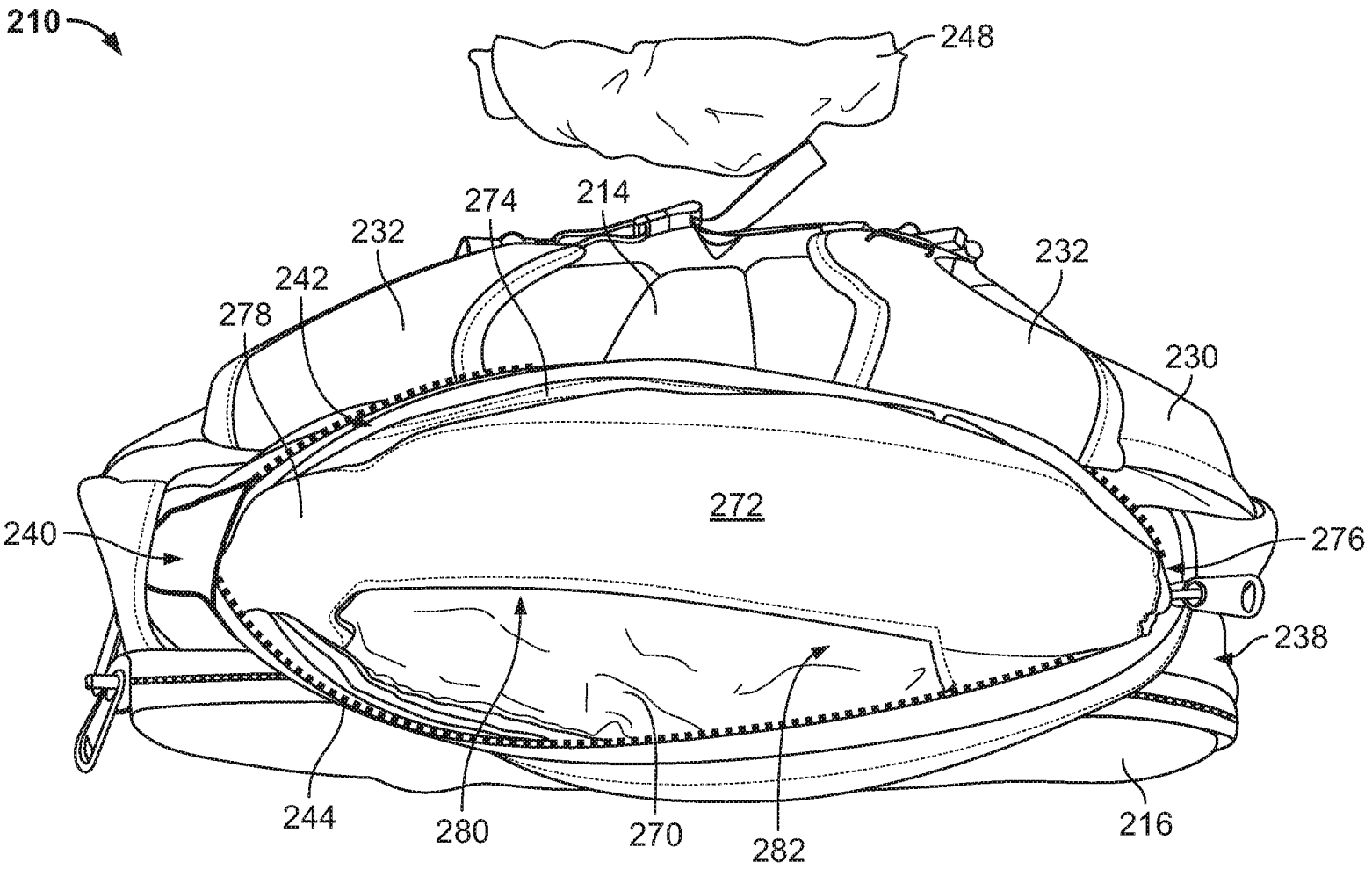
FIG. 15 is a view similar to FIG. 14, but with the rain cover retrieved from the interior of backpack haul strap and placed next to the backpack, and showing the access pathway at the segment of material that is not affixed though which the rain cover was retrieved from behind/beneath the segment of material.

FIG. 14 is a view similar to FIG. 13, but with the haul handle 240 being opened in an accentuated manner to show a majority of a periphery of the segment of material 272. As will be described further following, the segment of material 272 is affixed within the haul handle 240 and at least one portion of the periphery of the segment of material that is not affixed within the haul strap providing an access pathway, to a portion of the hollow interior on a side of the segment of material away from the closure, though which the rain cover 248 may be stowed and retrieved. FIG. 15 is a view similar to FIG. 14, but with the rain cover 248 retrieved from the interior of haul handle 240 and placed next to the backpack 210. As will be described further following, the access pathway at the segment of material 272 that is not affixed was the pathway through which the rain cover was retrieved from behind/beneath the segment of material 272.

The haul handle 240 includes the segment of material 172 (see FIGS. 13-15) located within the hollow interior 270 of the haul handle 240. The segment of material 272 is affixed (e.g., via stitching or similar) along a majority of a periphery 274 (FIGS. 14 and 15) of the segment of material within the haul handle 240. At least one portion of the periphery 274 of the segment of material is not affixed within the haul handle 240. Within the shown example, there are two open ends 276 (left and right ends as viewed within FIGS. 13-15, but with only the one, right side exposed) that are not affixed. Such provides openings at each of the two (i.e., left and right) open ends 276. The two open ends 276 are at opposed ends of the segment of material 272.

Also note (see FIGS. 13-15) that a portion at the middle of the segment of material 172 is cropped/removed such that the segment of material 172 is not affixed to the interior of the haul handle 240 at the middle location. Such provides a middle opening 282. Within the shown example cropped/removed portion from the segment of material 172 has a general trapezoidal shape. This the middle opening 282 has a general trapezoidal shape. Also note that the cropped/removed portion from the segment of material 172, and thus the middle opening 282, is located toward either a forward or aft direction of a left-right center line of the segment of material 172. Within the shown example, the left-right center line of the segment of material 172 is generally the location over which the closure device/feature (e.g., zipper) 244 will lie when closed.

Within the shown example, the cropped/removed portion from the segment of material 172, and thus the middle opening 282, is located forward of a left-right center line of the segment of material 172. As such, the cropped/removed portion from the segment of material 172, and thus the middle opening 282, is located toward the front of the backpack 210. Moreover, the cropped/removed portion from the segment of material 172, and thus the middle opening 282, is located so as to not lie beneath the closure device/feature (e.g., zipper) 244 will lie when closed.

The segment of material 272 has a side (e.g., a face) 278 extending to face the closure device/feature (e.g., zipper) 244, particularly when the closure device/feature (e.g., zipper) is closed. Of course, there is an opposite side (e.g., a face) extending to face away from the closure device/feature (e.g., zipper) 244. Such opposite/facing-away side is hidden and not visible in FIGS. 13 and 14. However, the presence of the opposite/facing-away side 280 is indicated in FIG. 15. Each of the open ends 276 and middle opening 282 provides the access pathway to a portion of the hollow interior 270 on a side of the segment of material 272 away from the closure device/feature (e.g., zipper) 244. It is to be noted that the access pathway at one of the open ends 276 and the middle opening 282 can be used to for ingress/egress of the rain cover 248 into/from behind/beneath the segment of material 272 and thus the hollow interior (rain cover storage compartment) 270.

As can be appreciated the rain cover 248 is configured and sized to cover at least the backpack body 214. It is to be noted that the rain cover 248 is shown in FIGS. 13-15 in a rolled/folded condition. It is when the rain cover 248 is unrolled/unfolded to a deployed extent does the rain cover 248 provide such covering of at least the backpack body 214. Once deployed, the rain cover 248 extends, e.g., from the top/upper portion 238 downwardly, to cover over the entire backpack body 214 to protect the backpack body and the articles contained within the backpack body from precipitation, or other elements or items, while the backpack is worn by the user. So, to be clear, the rain cover 248 has at least a stowed condition within the rain cover storage compartment 270 of the haul handle 240. The rain cover 248 is completely and exclusively within the haul handle 240 and located at the side (e.g., see side 280 within FIG. 15) of the segment of material 272 away from the closure device/feature (e.g., zipper) 244. When stowed, the rain cover 248 provides padding to the haul handle 240 when the hand of the user grasps the haul handle to pick-up the backpack 210.

It is to be appreciated that the novel use of the segment of material 272 within the haul handle 240 provides protection to the rain cover 248 so that the rain cover 248 is not damaged (e.g., torn or snagged) during operation of the closure device/feature (e.g., zipper) 244. The novel use of the segment of material 272 within the haul handle 240 provides protection to the closure device/feature (e.g., zipper) 244 such that the rain cover 248 does not become bound or lodged into the closure device/feature (e.g., zipper) during operation of the closure device/feature (e.g., zipper).

It is to be understood that the rain cover 248 is placed beneath (as viewed within the figures) the segment of material 272. Such placement of the rain cover 248 is via insertion at one of the open ends 276 or the middle opening 282. In some respects, the novel use of the segment of material 272 allows the rain cover 248 to be neatly and compactly stored within the haul handle 240 via an initial holding of the rain cover 248 while the closure device/feature (e.g., zipper) 244 is operated to provide some further compacting/compression.

It is to be noted that the shown example presents the haul handle 240, and thus the contained rain cover 248 therein, away from the portions (e.g., the shoulder straps 232) of the backpack 210 that directly engage the body of the use and/or the backpack body 214 itself, which, of course, is for contents that are to be protected from water, etc. To be clear, the haul handle 240, and thus the contained rain cover 248 therein, is not integrated into the shoulder straps 232 and/or the backpack body 214. Such construction is such that even if the rain cover 248 might be re-stowed after use (i.e., possibly wet), there is no transfer of water, etc.

The above disclosure will enable one of ordinary skill in the art to practice the invention. The disclosure provides a disclosure of embodiments of the invention. However, the embodiments do not limit the invention to the exact construction, dimensional relationships, and operation shown and described. Modifications, alternative constructions, changes and equivalents will readily occur to those skilled in the art and may be employed, as suitable, without departing from the true spirit and scope of the invention.

Therefore, the above description and illustrations should not be construed as limiting the scope of the invention, which will be defined by claims presented in a non-provisional patent application claiming the benefit of the filing date of this provisional patent application.

The foregoing disclosure is sufficient to enable those with skill in the relevant art to practice the invention without undue experimentation. The disclosure further provides the best mode of practicing the invention now contemplated by the inventor.

While the particular backpack and rain cover storage method herein shown and disclosed in detail is fully capable of attaining the objects and providing the advantages stated herein, it is to be understood that it is merely illustrative of the presently preferred embodiment of the invention and that no limitations are intended to the detail of construction or design herein shown other than as defined in the appended claims. Accordingly, the proper scope of the present invention should be determined only by the broadest interpretation of the appended claims so as to encompass all such modifications as well as all relationships equivalent to those illustrated in the drawings and described in the specification.

What is claimed is:

1. A backpack comprising:

a backpack body, being a main portion of the backpack, to be located adjacent to a back of a user of the backpack while the backpack is worn by the user, the backpack body including at least one hollow interior that forms a closable body compartment to receive articles therein;

at least one shoulder strap to be located over a shoulder of the user while the backpack is worn by the user, the at least one shoulder strap being attached to the backpack body at an upper, as defined while the backpack is worn by the user, portion of the backpack and extending down and away from the upper portion;

a haul handle to be grasped by a hand of the user to pick-up the backpack, the haul handle being a separate item from the backpack body and being a separate item from the at least one shoulder strap, the haul handle being located at the upper portion of the backpack and attached to at least one of the backpack body and the at least one shoulder strap, the haul handle and the least one of the backpack body and the at least one shoulder strap to which the haul handle is attached together encircle a grasp area for receiving a hand grasping the haul handle, the haul handle including a hollow interior and a closure so as to form a selectively openable rain cover storage compartment, the rain cover storage compartment being separate from and outside of the body compartment of the backpack body to avoid possible contamination into the body compartment of the backpack body from the rain cover storage compartment, the haul handle including a segment of material located within the hollow interior of the haul handle and affixed along a majority of a periphery of the segment of material within the haul handle, the segment of material having a side extending to face the closure, at least one portion of the periphery of the segment of material that is not affixed within the haul strap providing an access pathway to a portion of the hollow interior on a side of the segment of material away from the closure; and a rain cover configured and sized to cover at least the backpack body, the rain cover having at least a deployed condition in which the rain cover extends from a top portion of the backpack body downwardly to cover over the entire backpack body to protect the backpack body and the articles contained within the backpack body from precipitation while the backpack is worn by the user during precipitation, and the rain cover having at least a stowed condition within the rain cover storage compartment of the haul handle, in which the rain cover is completely and exclusively within the haul handle and located at the side of the segment of material away from the closure, with the rain cover providing padding to the haul handle when the hand of the user grasps the haul handle to pick-up the backpack.

2. The backpack of claim 1, wherein the at least one portion of the periphery of the segment of material that is not affixed within the haul handle being located at an end of the segment of material.

3. The backpack of claim 1, wherein the at least one portion of the periphery of the segment of material that is not affixed within the haul handle includes at least two portions that are not affixed within the haul handle.

4. The backpack of claim 3, wherein the at least two portions are located at opposed ends of the segment of material.

5. The backpack of claim 1, wherein the at least one portion of the periphery of the segment of material that is not affixed within the haul handle being located at a middle of the segment of material.

6. The backpack of claim 1, wherein the at least one portion of the periphery of the segment of material that is not affixed within the haul handle being located so as to not lie beneath the closure when the rain cover storage compartment is selectively closed.

7. The backpack of claim 1, wherein the haul handle is not integrated into the at least one shoulder strap and the backpack body.

8. The backpack of claim 1, wherein the closure of the haul handle including a zipper that selectively closes an opening located at an upper, as defined while the backpack is worn by the user, portion of the haul handle, a lower portion of the haul handle being for engagement with the hand of the user when the haul handle is grasped by the hand of the user to pick-up the backpack, and the rain cover while in the stowed condition provide the padding to the haul handle.

9. The backpack of claim 1, wherein the at least one shoulder strap, the haul handle and the rain cover are configured such that the rain cover is separate from use and operation of the at least one shoulder strap for both the stowed and deployed conditions of the rain cover.

10. The backpack of claim 1, wherein the haul handle, and the rain cover storage compartment thereof, and the backpack body are configured such that the hand of the user extends between the haul handle and the backpack body to grasp around the haul handle, the rain cover storage compartment thereof and the rain cover when the rain cover is in the stowed condition within the rain cover storage compartment.

11. The backpack of claim 1, wherein the haul handle, and the rain cover storage compartment thereof, and the backpack body are configured such that the rain cover does not extend into the backpack body when the rain cover is in the stowed condition.

12. The backpack of claim 1, wherein the haul handle, and the rain cover storage compartment thereof, and the backpack body are configured such that the backpack body is not accessed to actuate the rain cover from the stowed condition to the deployed condition.

13. The backpack of claim 1, wherein the haul handle, and the rain cover storage compartment thereof, and the rain cover are configured such that the rain cover, when in the stowed condition, provides no interference to the access and use of the haul handle.

14. The backpack of claim 1, further including closure means for securing the rain cover tightly around the backpack body.

15. The backpack of claim 14, wherein the closure means includes at least one of an elastic drawstring closure and a cinch closure with a cord lock.

16. The backpack of claim 1, wherein the rain cover is a combined pack cover and hood.

* * * * *